US005224619A

United States Patent [19]

Dilworth et al.

[11] Patent Number: 5,224,619

[45] Date of Patent: Jul. 6, 1993

[54] DISPENSING FLOWABLE CONTENTS FROM FRANGIBLE PACKAGING

[76] Inventors: Tom F. Dilworth, 2383 Cotswold Crescent, Burlington, Ontario, Canada, L7P 4M3; Gilbert L. Cooper, 480 Heather Hill Court, Ancaster, Ontario, Canada, L9G 3W6

[21] Appl. No.: 776,421

[22] PCT Filed: Jun. 21, 1990

[86] PCT No.: PCT/CA90/00199

§ 371 Date: Nov. 21, 1991

§ 102(e) Date: Nov. 25, 1991

[87] PCT Pub. No.: WO90/15561

PCT Pub. Date: Dec. 27, 1990

[30] Foreign Application Priority Data

Jun. 21, 1989 [CA] Canada ..... 603551

Sep. 29, 1989 [CA] Canada ..... 614817

[51] Int. Cl.[5] ..... B65D 17/42

[52] U.S. Cl. ..... 220/277; 222/83; 222/83.5; 222/88

[58] Field of Search ..... 220/260, 277, 400, 403, 220/461, 470; 81/3.48; 222/80, 81, 83, 83.5, 88, 89, 90, 105

[56] References Cited

U.S. PATENT DOCUMENTS

| | | | |
|---|---|---|---|
| 1,316,122 | 9/1919 | Vall | 222/88 |
| 1,364,889 | 1/1921 | Rupp | 222/86 X |
| 2,063,525 | 12/1936 | Schickel | 222/83 |
| 2,179,772 | 11/1939 | Willis | 222/83 |
| 2,571,798 | 10/1951 | Ureh | 222/83.5 |
| 2,806,635 | 9/1957 | Kader et al. | 222/88 |
| 3,549,049 | 12/1970 | Weber | 222/91 |
| 4,247,020 | 1/1981 | Desjardins | 222/83.5 |
| 4,322,019 | 3/1982 | Smith | 222/83.5 |
| 4,562,940 | 1/1986 | Asphar | 222/88 |
| 4,907,722 | 3/1990 | Ueda et al. | 222/83 |

*Primary Examiner*—Stephen P. Garbe
*Assistant Examiner*—Nova Stucker
*Attorney, Agent, or Firm*—Patrick J. Hofbauer

[57] ABSTRACT

The present invention relates to a device comprising a supported apical piercing spike oriented and stabilized in supported relation on a support adapted to be positioned within a container. The container has a hollow interior defined between a distal end and a contiguous side wall extending upwardly from the distal end to a proximal end which opens into the interior. The support means is positionable adjacent the distal end with the apical piercing spike extending within the interior, away from the distal end and towards the above mentioned opening. In use, a frangible container of goods that is introduced into the interior of the container through the opening is impaled on the piercing spike, thereby permitting the contents thereof to be released form the frangible packaging into the interior of the container.

7 Claims, 9 Drawing Sheets

DISPENSING FLOWABLE CONTENTS FROM FRANGIBLE PACKAGING

TECHNICAL FIELD

The present invention relates to improvements in containers and the like adapted for receiving the contents of frangible packaging, and especially to improvements in releasing the contents of such packaging into the container.

BACKGROUND OF ART

The use of frangible packaging for distribution and sale of consumer products at the retail level is a common practice. Perhaps one of the best known examples of this type of packaging is the use of plastic bags for the packaging of fluid milk. Juice and a wide variety of other potable beverages are similarly packaged.

Devices intended to facilitate the opening of this kind of packaging, abound. Exemplary of such devices are the so-called "snippits" which typically have a short blade oriented along at least one of two convergent sides that bound a channel through which a portion of the packaging is manually guided. The blade contacts the packaging and severs a portion thereof, opening the packaging in such a way as to permit the contents to be dispensed. The contents are then poured into a rigid container. Alternatively the frangible container is placed in a rigid support (typically a container), opened, and the contents are dispensed from there directly.

French Patent No. A-1458519 (Berducone), Nov. 10, 1966, discloses a device having a piercing blade centrally positioned within a cylindrical tube. The device has an open top and bottom, such that a frangible package can be inserted within the tube to be pierced by the blade, so as to transfer the contents of the frangible package to another container, in the nature of a funnel.

The problem of pouring the containers from the frangible container into a separate container is that the contents are often spilled in the process, especially when the packaging is for example, a relatively light gauge polyethylene, and the contents are liquid. Although the contents can be dispensed directly from the frangible packaging when it is supported in a container, the contents often drip down the exterior of the packaging and lodge between it and the interior walls of the container. Since the exterior of the packaging is seldom washed by the consumer prior to being used, there is substantial risk of unwanted contaminants finding their way into the contents that become trapped between the packaging and the container. This liquid can flow back up the container when further liquid is subsequently dispensed therefrom and mixes with the contents being dispensed from the packaging for the first time. The result is at the very least unhygienic and the potential exists for microbiological hazard.

There continues to be a need for improved containers and means for dispensing contents from frangible packaging.

SUMMARY OF THE INVENTION

The present invention relates generally to a device comprising supported apical piercing means oriented and stabilized in supported relation on support means and adapted to be positioned within a container having a hollow interior defined between a distal end and mutually contiguous side walls extending upwardly from the distal end to a proximal end which opens into the interior.

In accordance with one aspect of the present invention there is provided a device comprising supported apical pierceing means oriented and stabilized in supported relation on support means and adapted to be positioned within a container having a hollow interior defined between a distal end and mutually contiguous side walls extending upwardly from the distal end to a proximal end which is open to said interior. Examples of apical piercing means include by way of example, spikes (which may take the form of, for example, conical or cruciform heads), or cannular tubes or the like. The support means is positionable adjacent to the distal end of the container with the apical piercing means extending within the interior, away from said distal end and towards the opening In use, a frangible container of goods is introduced into the interior of the container through the above mentioned opening and is impaled on the piercing means, permitting the contents thereof to be released from the frangible packaging into the interior of the container.

This device affords the advantages of having the container support the frangible packaging and directing the flow of contents released therefrom between the side walls so as to confine the contents within the container to thereby help reduce spillage, and in the case of liquid contents, splashing too.

In accordance with one aspect of the present invention the support means is integrally formed with the distal end and contiguous with the side walls. As an integral part of the dispensing container the device of the present invention is advantageously always to hand, and is not as readily lost as are the above-mentioned "snippits". Moreover, the device is cleaned with every cleaning of the container, and is not overlooked in the same way as the "snippits" can be if they are simply returned to the kitchen drawer or otherwise stored immediately after use by the consumer.

In accordance with another aspect of the present invention there is provided a device including apical piercing means adapted to pierce frangible packaging and being supported on support means at a first end thereof which is positionable in removable relation within a container, with said apical piercing means oriented and stabilized interiorly of said container in operable position therein, said support means having second graspable end spaced apart from the first and adapted to extend exteriorly of said container when said first end is so positioned. With the first end of the support means removably positioned adjacent to the distal end of the container, the apical piercing means preferably extends within the interior and away from the distal end, towards the opening at the proximal end. In an especially preferred form of this aspect of the present invention, the apical piercing means is positionable adjacent the distal end of the container in spaced apart relation from the side walls thereof, and the support means is adapted to extend, from the first end thereof, generally along the base at the distal end towards the side walls, and then adjacent the side walls upwardly towards the proximal end, and through the opening to the second end located exteriorly of the container.

In accordance with a further aspect of the present invention the apical piercing means is supported on a generally conical support means operable to spread the pierced flangible packaging and thereby enlarge the opening therein through which the contents thereof are released into the container. This considerably expedites dispensing the contents of the packaging, especially in the case of non-liquids, such as large particulates e.g. coffee beans, ground coffee, or the like.

According to a further variation, the sides of the conical support are adapted to smoothly distribute an initial flow of the contents outwardly towards the side walls. This arrangement helps to minimize splashing of contents back onto the exterior surfaces of the packaging. In the case of particulates the cone helps to direct the contents outwardly away from the hole in the packaging, and thus prevents "log-jams". In one form of the invention, the generally conical side walls define a concave surface intermediate the apex and base thereof.

In a preferred embodiment of the present invention, the apical piercing means and support are formed from a tapering spike formed from mutually converging sides of a plurality of cross pieces, preferably three and even more preferably four in number forming a support and piercing means having a cruciform cross section. In this embodiment the mutually spaced sides of the three or more cross pieces can tension the flangible packaging along hinge lines formed therein between adjacent pairs of the cross pieces. The weight of the contents acting across the hinge lines open the packaging and enhance the product flow from the pierced package.

BRIEF DESCRIPTION OF DRAWINGS

In the course of the following detailed description of preferred embodiments of the present invention reference will be made to the drawings as appended hereto, and in which.

Figure 1:
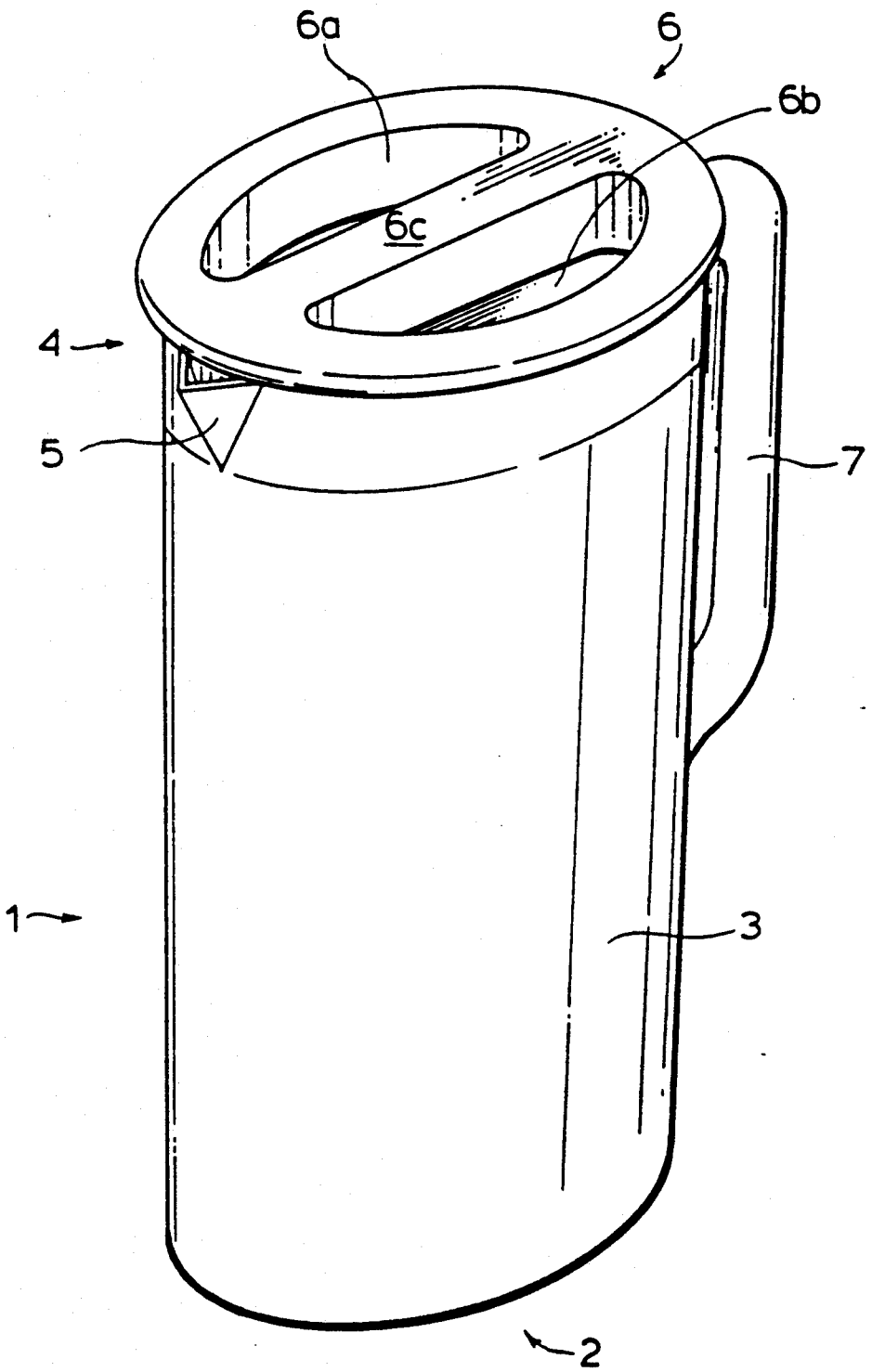
FIG. 1 is a perspective view of a container for storing and dispensing various liquids, especially beverages, and in particular milk.
Figure 2A:
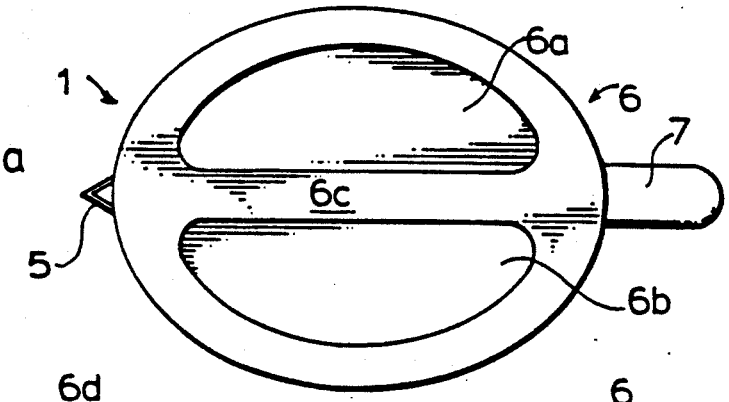
Figure 2B:
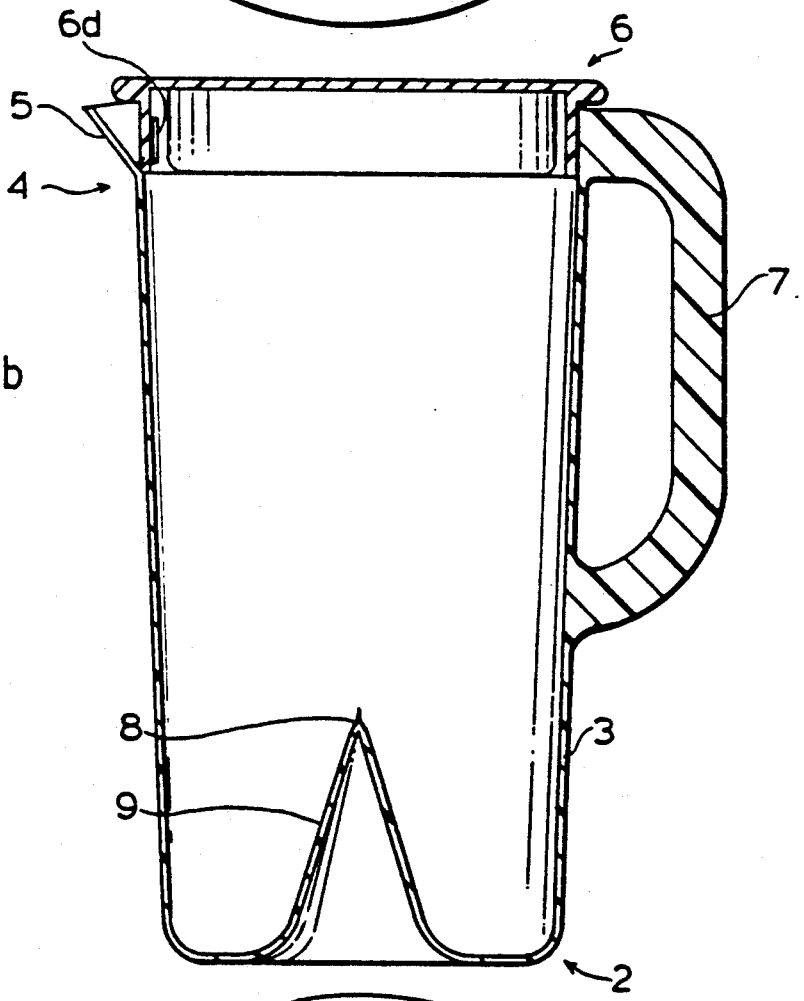
Figure 2C:
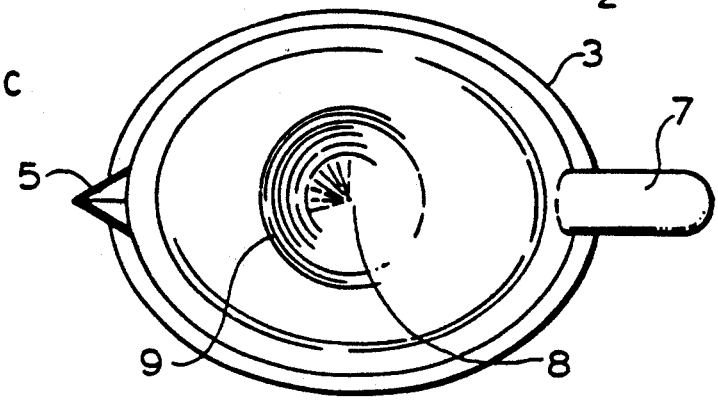
Figure 3:
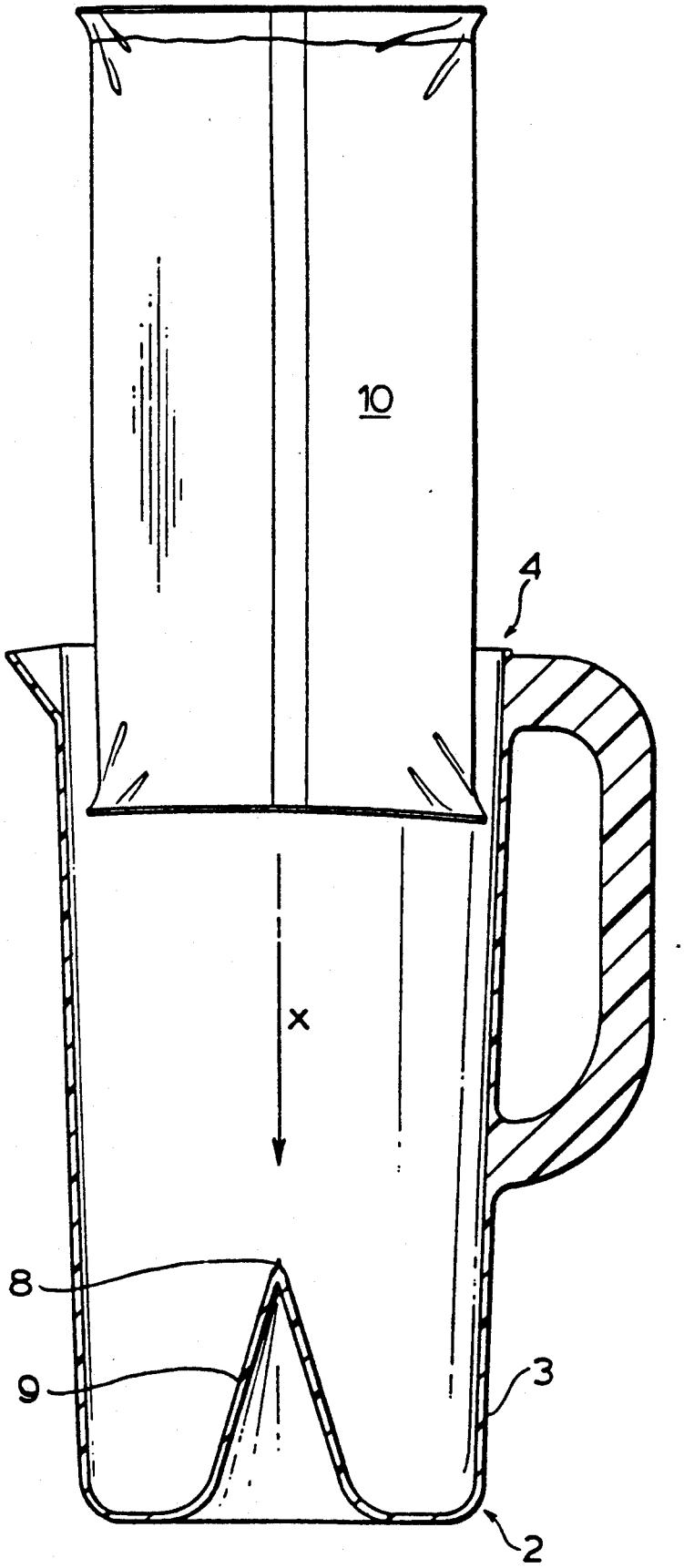
Figure 4:
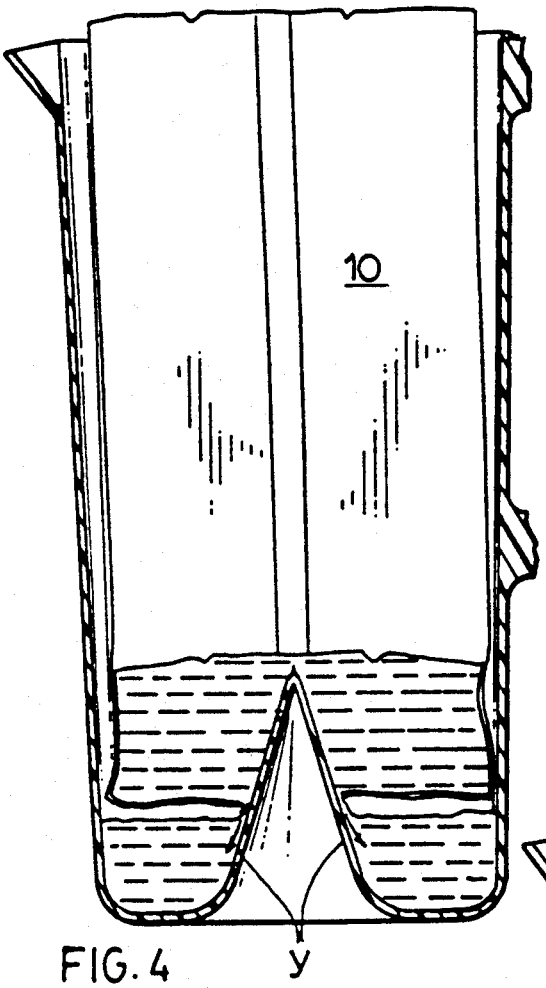
Figure 5:
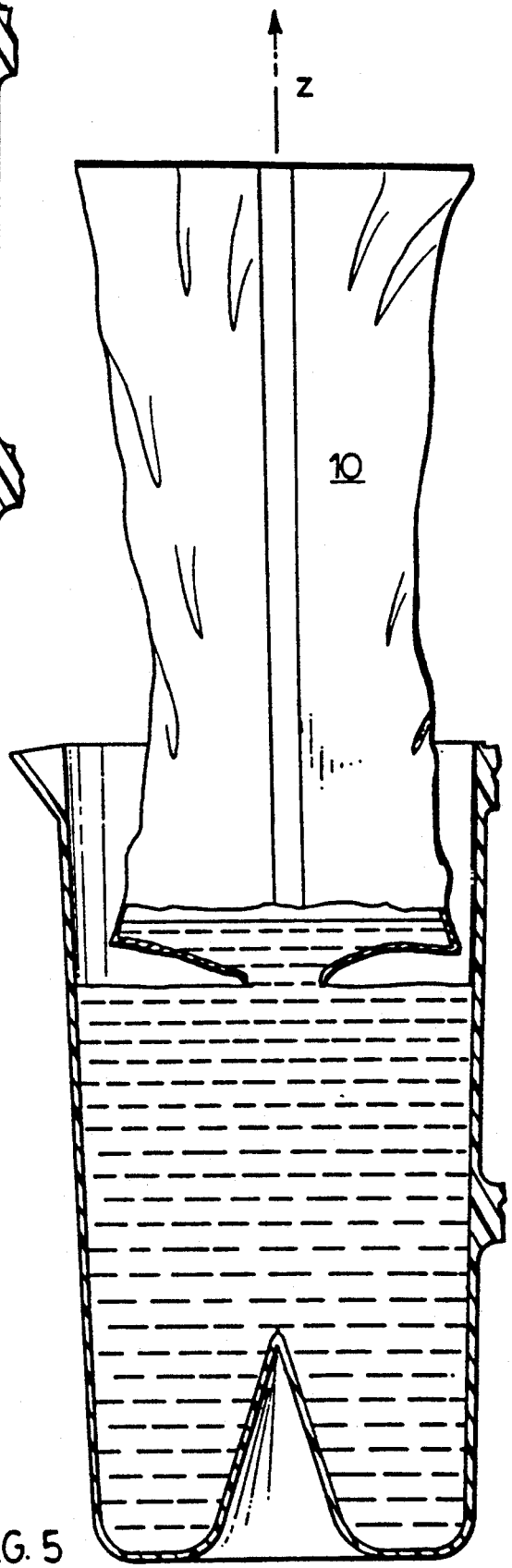
Figure 6:
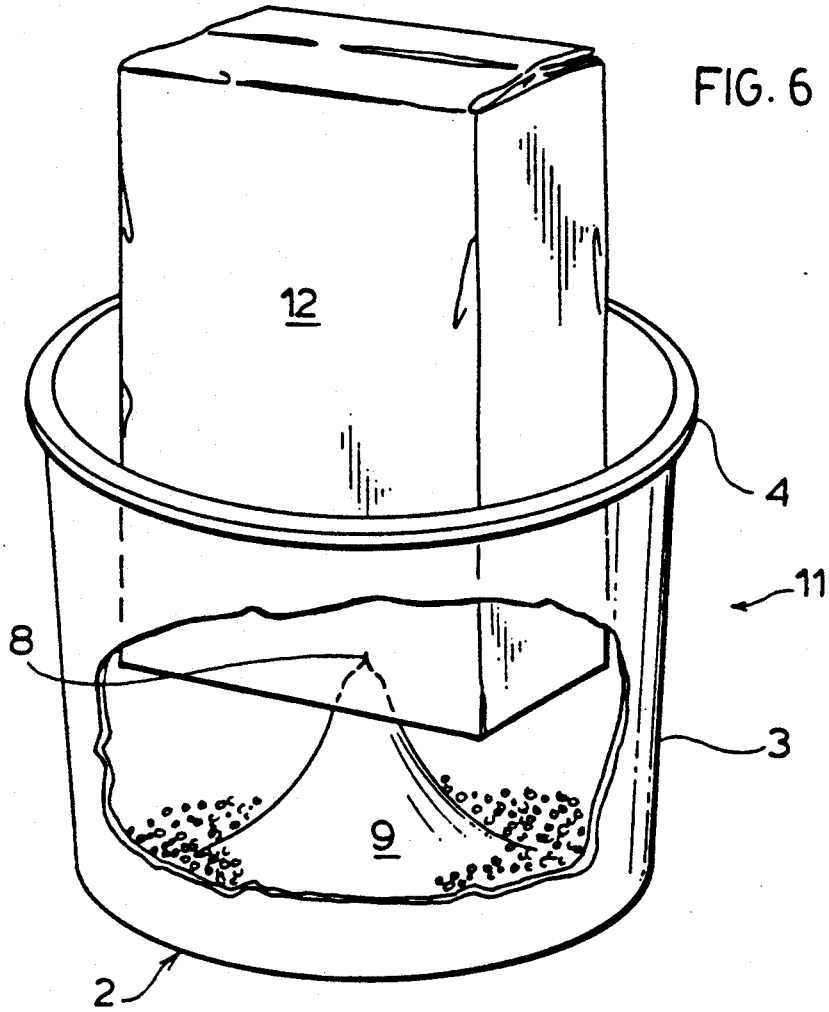
Figure 7:
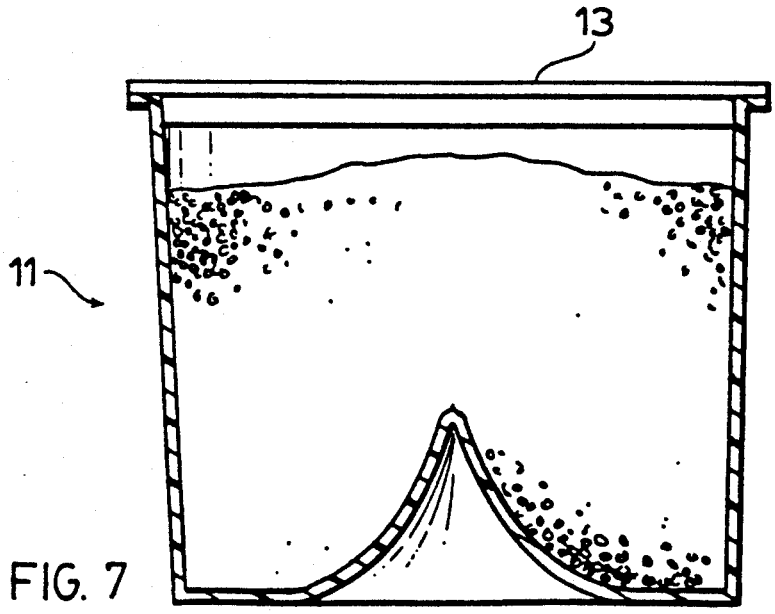
Figure 9:
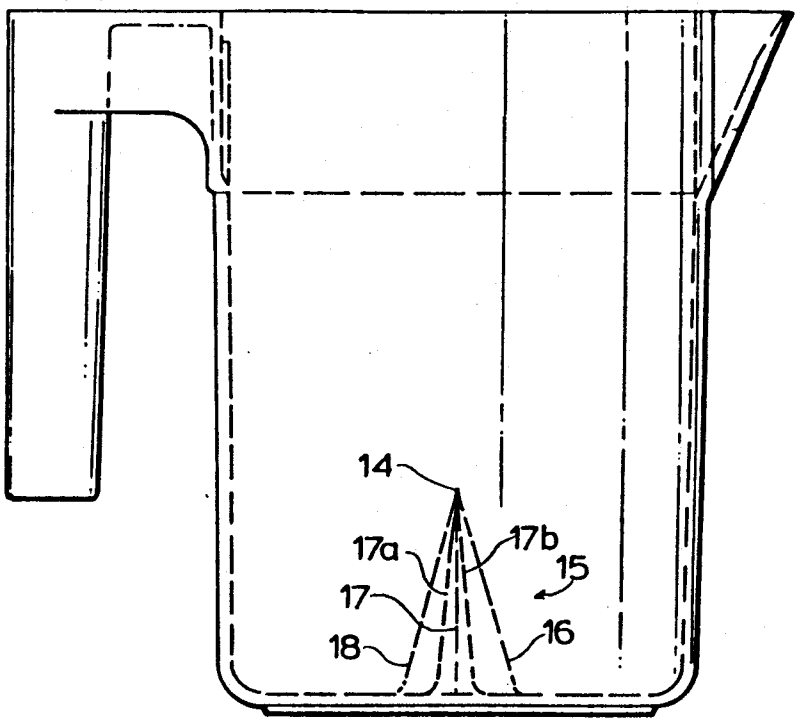
Figure 8:
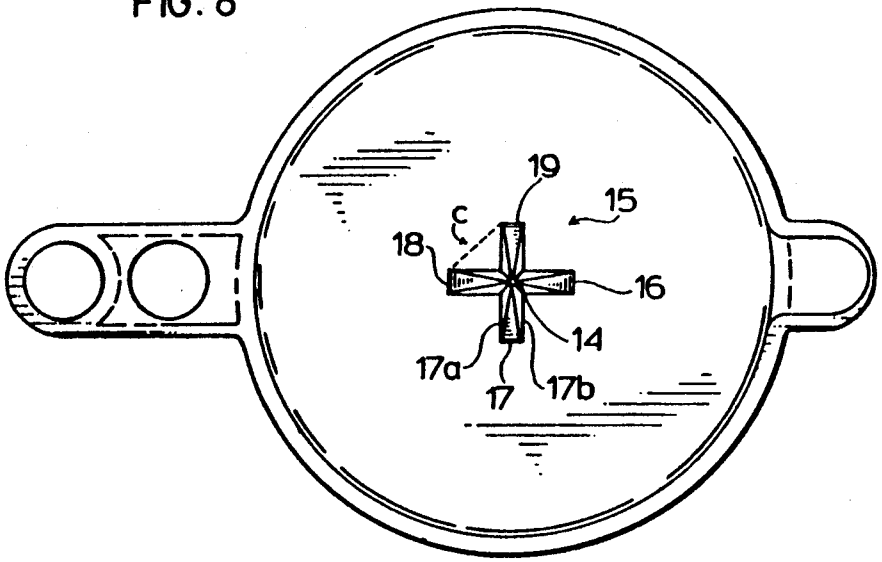
Figure 10:
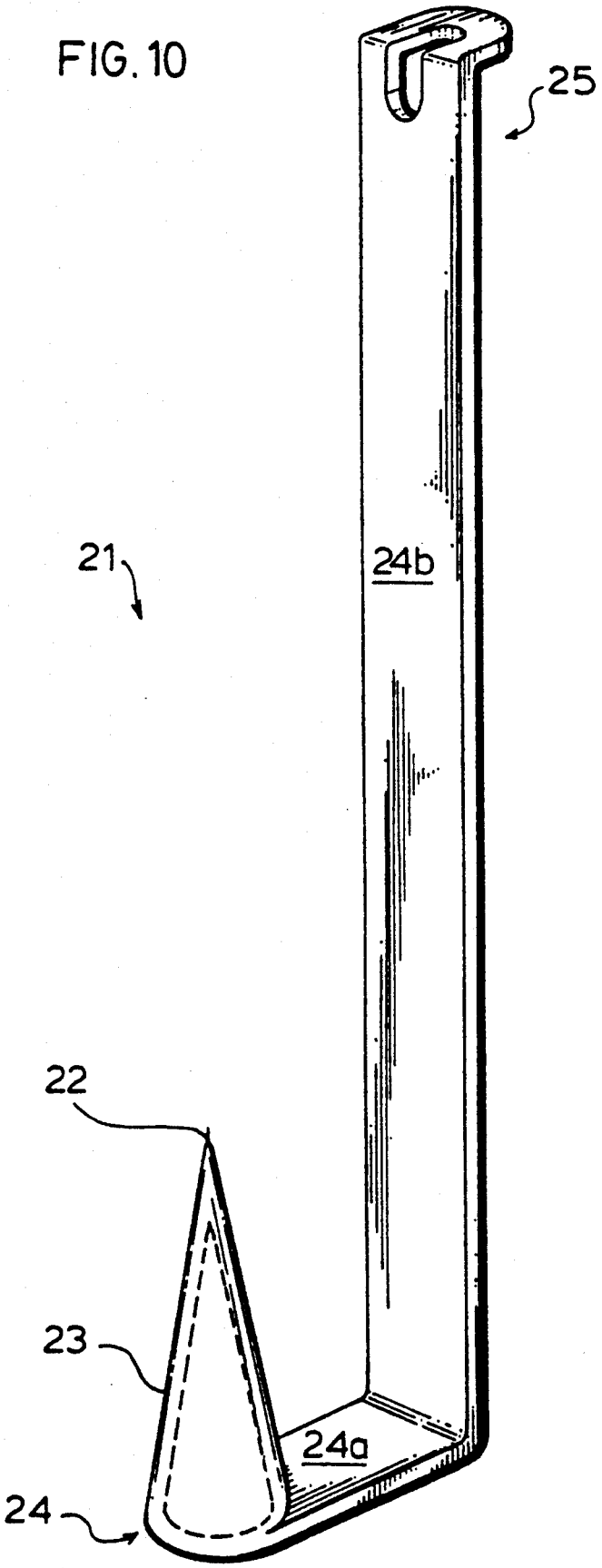
Figure 11:
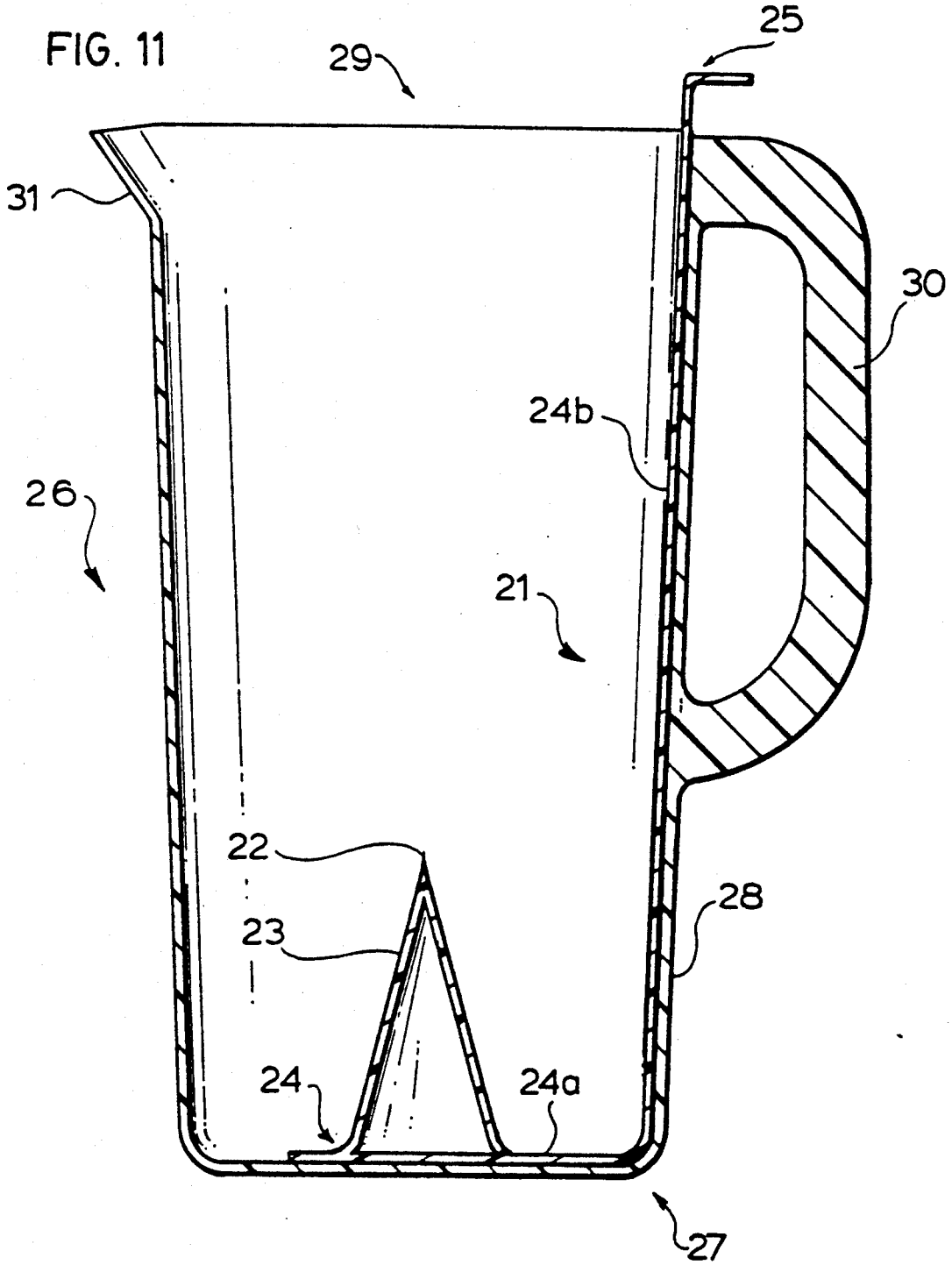

FIGS. *2a*, *2b* and *2c* are respectively, a plan view with a cover in place, a cross-sectional side elevation view, and a plan view with the cover removed, of the container depicted in FIG. 1, with FIGS. *2b* and *2c* illustrating the details of one embodiment of the present invention;

FIGS. 3, 4 and 5 are views taken in cross-section through a container of the present invention, similar to the view shown in FIGS. *2b*, and illustrating sequential stages of the container in use;

FIGS. 6 and 7 are views of an alternative embodiment of a container of the present invention;

FIGS. 8 and 9 of the drawings depict a preferred embodiment of the present invention in plan view and in longitudinal cross section, respectively;

FIG. 10 is a perspective view of a preferred embodiment of another device of the present invention; and, FIG. 11 is a view taken in cross-section through a container illustrating the device shown in FIG. 10, positioned for use therein.

Figure 12:
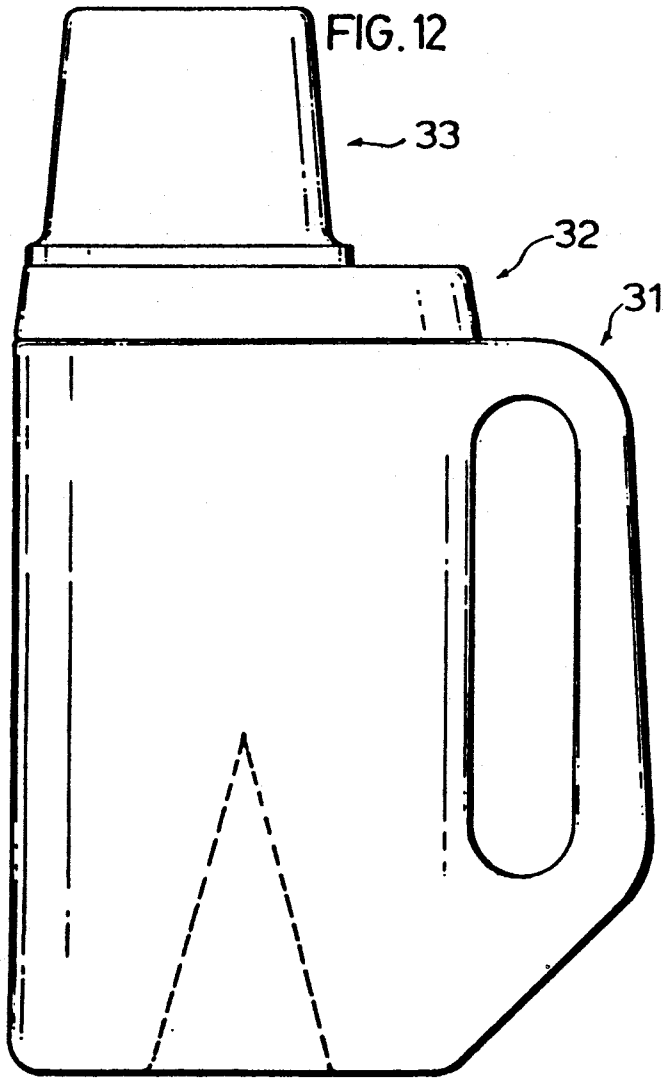

FIG. 12 of the drawings illustrates the present invention as it might be used in conjunction with an integrally formed, dispensing container.

Figure 13:
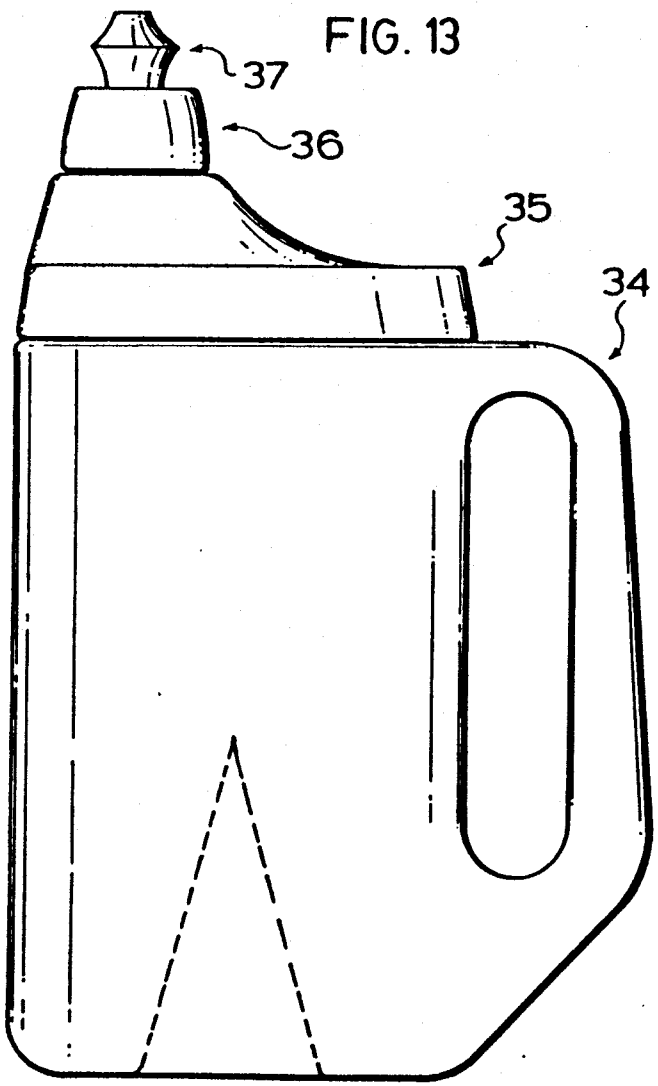

FIG. 13 of the drawings illustrates the present invention as it might be used in conjunction with yet another integrally formed dispensing container.

BEST MODES FOR CARRYING OUT THE INVENTION AND INDUSTRIAL APPLICABILITY

Referring now to FIG. 1 of the drawings there is shown a perspective view of a container 1, for storing and dispensing various liquids, especially beverages, and in particular milk. Container 1 comprises a hollow interior defined between a distal end 2, and mutually contiguous side walls 3, extending upwardly from the distal end 2, to a proximal end 4, which is open to the interior. Container further includes a handle 7 and a pouring spout 5. Container 1, is illustrated in combination with a removable lid 6, having on mutually opposed sides thereof, finger well depressions *6a* an *6b*. Intermediate these finger well depressions *6a* and *6b* is a graspable island *6c*, to facilitate handling of the lid 6. Container 1 is shaped as a laterally flattened cylinder and has a generally oval cross-section throughout the length of its longitudinal axis. The container 1 is also tapered inwardly slightly from the proximal to the distal ends, 4 and 2 respectively.

FIG. *2a* of the drawings is a plan view of container 1 shown with lid 6 removably positioned in closing relation over the opening at proximal end 4.

FIG. *2b* of the drawings is a cross-sectional taken along the longitudinal axis of container 1, with lid 6 place. Lid 6 engages side walls 3 in frictional engagement adjacent proximal end 4. Lid 6 includes a slotted strainer *6d* positioned in register with spout 5, which is useful for, amongst other things, retaining ice cubes or relatively large pieces of fruit within the interior of container 1 during pouring. Also shown in FIG. *2b* is a supported apical piercing means 8, oriented and stabilized in supported relation on support means 9. The support means 9 is positioned adjacent the distal end 2 with the apical piercing means 8 extending within the interior of container 1, away from the distal end 2, and towards said opening at proximal end 4.

FIG. *2c* of the drawings is a plan view from a perspective similar to that used in FIG. *2a*, but showing instead container 1 with lid 6 removed and the interior exposed. The contours of support means 9 can be more readily visualized from this view. In addition this Figure helps to illustrate the slight inward taper of the container from the proximal to the distal ends, 4 and 2 respectively.

FIG. 3 of the drawings is the first in a sequence of drawings, including FIGS. 4 and 5, showing a typical milk bag 10 as an example of a frangible container the contents of which are to be dispensed into container 1. Accordingly, FIG. 3 depicts bag 10 being inserted into the opening in container 1 adjacent the proximal end 4 thereof, in the direction indicated by the arrow marked "x". Bag 10 is inserted substantially as shown until is comes into contact with apical piercing means 8. Referring now to FIG. 4, bag 10 is shown having been pierced by means 8, with the hole in bag 10 having been substantially widened by the wedge like action of support means 9. The contents of bag 10 are illustrated as flowing out of bag 10 into the interior of container 1, following an outwardly divergent path down the sides of support means 9. As shown in FIG. 5, bag 10 is lifted out of the interior of container 1 in the direction indicated by the arrow marked "z", just ahead of the rising liquid level as the contents are transferred from the frangible packaging of bag 10 and into container 1.

FIGS. 6 and 7 of the drawings illustrate another embodiment of the present invention. Container 11 is a generally cylindrical, slightly downwardly tapered container. The container includes a distal end 2 having upwardly extending contiguous side walls 3 ending adjacent a proximal end 4, in a reinforced lip for stabilizing the container and securing a lid thereto.

In FIG. 6, box 12 is shown partially inserted into the opening adjacent proximal end 4. Through the partially cut away view of container 11, a portion of box 12 can be seen positioned above means 8. As with the embodiment described in the preceding Figures, means 8 is supported on support 9. The box 12 is a frangible package containing ground coffee, and once the box 11 has been punctured by means 8, and the hole this created widened by support 9, the ground coffee falls onto the sides of the support 9 and outwardly towards walls 3 along the sides of that support. As the box 12 is further withdrawn from the interior of container 11, the balance of its contents are dispensed into container 11. Once the transfer from packaging to container is complete container 11 can be sealed with removable lid 13. Although not shown in the drawings, lids useful in conjunction with the present invention can bear surface features if desired, that are adapted to be received in register with the underside of containers such as container 13, and particularly in register with the exterior surface of support means 9. In this aspect of the invention, stacked containers can be arranged in interfitting relation for improved stability.

Referring now to FIGS. 8 and 9 of the drawings, there is shown a supported apical piercing means 14 arranged on a tapering support 15 comprising four contiguous cross pieces 16, 17, 18 and 19. The cross pieces are joined to one another along respective first sides thereof offset from one another at a ninety degree angles, and are each tapered from the base towards the apex of the support 15 along respective second sides thereof. In addition, respective pairs of mutually opposed surfaces extending between respective first and second sides (see 17*a* and 17*b*, for example) of each of the cross pieces also converge together from the base towards the apex of the support 15. In this way the resulting wedging action which takes place between the surfaces, especially along the respective second sides of the support enhance the opening of the frangible container. In addition, and has already been briefly mentioned hereinbefore, the mutually spaced apart second sides of the cross pieces can tension the frangible packaging along hinge lines (see line c shown in phantom FIG. 8) formed therein between adjacent pairs of the cross pieces. The weight of the contents acting across such hinge lines on the generally triangular flap formed in the packaging by the action of this preferred embodiment of the invention, serve to open the packaging and enhance the product flow from the pierced package.

Referring now to FIG. 10 of the drawings there is shown a device 21 including apical piercing means 22 adapted to pierce frangible packaging and being supported on support means 23 at a first end 24 of the device 21. Support means 23 is positionable in removable relation within a container (not shown in this Figure, but see FIG. 11), with the apical piercing means 22 oriented and stabilized in operable position interiorly of the container. The support means 23 has a second graspable end 25 spaced apart from the first end 24 and adapted to extend exteriorly of the container when the first end 24 is positioned therein in the manner aforesaid. As illustrated in this figure, the apical piercing means 22 is supported on a generally conical support means 23, that is itself operable to spread the pierced frangible packaging and thereby enlarge the opening therein through which the contents thereof are released into the container. Moreover, the sides of the conical support means 23 are adapted to smoothly distribute an initial flow of the packages contents outwardly towards a containers side walls.

Referring now to FIG. 11 of the drawings there is shown a cross sectional view through a container 26, for storing and dispensing various liquids, especially beverages, and in particular milk. Container 26 comprises a hollow interior defined between a distal end 27, and mutually contiguous side walls 28, extending upwardly from the distal end 27, to a proximal end 29, which is open to the interior. Container 26 further includes a handle 30 and a pouring spout 31. The container 26 is tapered inwardly slightly from the proximal to the distal ends, 29 and 27 respectively. With the device 21 of the present invention located within container 26, the apical piercing means 22 is positionable adjacent the distal end 27 of the container 26 in spaced apart relation from the side walls 28 thereof, and the support means 23 is adapted to extend, over the portion thereof indicated by reference numeral 24*a*, from the first end 24, generally adjacent the base of container 6 along the distal end 27 of the container 26, towards the side walls. Support means 23 then extends upwardly, adjacent the side walls towards the proximal end, and through the opening, over the portion of support means 3 indicated by reference numeral 24*b*, to the second end 25 located exteriorly of the container.

Referring now to FIG. 12 of the drawings there is shown a dispensing container including an integrally formed, supported apical piercing means illustrated in phantom. Container 31 has an open proximal end which has illustrated it is closed and removably capped relation by a primary cap 32. With cap 32 removed, the open proximal end is adapted to received frangible packaging in the manner earlier herein described. With the contents of the frangible packaging transferred to the interior of container 31, and primary cap 32 resecured in capping relation over the proximal opening, container 31 is adapted to dispense those contents through a dispensing opening (not shown) in primary cap 32. As illustrated, a secondary cap 33 is mounted in removable capping relation over said dispensing opening. In the illustrated embodiment, secondary cap 33 is also operable as a contents measuring and dispensing container.

Referring now to FIG. 13 of the drawings, there is shown in raised elevation, a supported apical piercing means of the present invention (in phantom) in conjunction with an integrally formed dispensing container 34. Dispensing container 34 includes a primary cap 35, illustrated in capping relation over a proximal opening (not shown) in container 34. As with the embodiment illustrated in FIG. 12, primary cap 35 is removable, so that frangible packaging can be introduced through the proximal opening in container 34, in accordance with the method earlier described.

With primary cap 35 secured again in capping relation over the proximal opening of container 34, the contents of container 34 can be dispensed from the container through a secondary cap 36, having user operable valve means 37. Valve means 37 is of a known type typically associated with liquid dispensers, and especially creams, lotions or higher viscosity comestible products, such as syrups or the like.

The embodiments of the invention in which an exclusive property or privilege is claimed are defined as follows:

1. A container having a hollow interior defined between a closed distal end and a contiguous side wall extending upwardly from the distal end to a proximal end which is open to said interior, and supported apical piercing means oriented and stabilized in supported relation on support means positioned on said distal end with the apical piercing means extending within the interior, away from said distal end and towards said opening, whereby a frangible package of goods that is introduced into the interior of said container through said open proximal end is impaled on said piercing means, permitting the contents thereof to be released from the frangible package into the interior of the container, characterized by the apical piercing means being supported on a tapered section of said support means comprising at least three solid contiguous triangularly shaped cross pieces joined to one another along respective first sides thereof, a radially offset at an angle from one another, each said cross piece being tapered from a base of the support means towards the apical piercing means along respective second sides of the cross pieces.

2. The container according to claim 1 comprising four cross pieces radially offset from one another at an angle of about 90 degrees, to thereby form a support having a cruciform cross section.

3. The container according to claim 1, wherein respective pairs of mutually opposed surfaces extend between respective first and second sides of each of the cross pieces also converge together from the base towards the apical piercing means of the support means.

4. An improved device for use within a container having a hollow interior defined between a distal end and a contiguous side wall extending upwardly from the distal end to a proximal end which is open to said interior, wherein a frangible package of goods may be introduced into the interior of the container through said open proximal end to be impaled on the previously inserted device, thereby permitting the contents of the frangible package to be released from the frangible package into the interior of the container, the device characterized by:

an apical piercing means oriented and stabilized in supported relation on a support means, the support means having a generally conical form defined by an apex, a base and a continuous outer concave surface intermediate said apex and said base, such that the said support means is operable to spread the pierced frangible package and thereby enlarge the opening therein through which the contents of the package are released into the container, and such that said continuous outer surface of the support means is adapted to smoothly distribute an initial flow of contents outwardly towards the side wall of the container.

5. An improved device for use within a container having a hollow interior defined between a distal end and a contiguous side wall extending upwardly from the distal end to a proximal end which is open to said interior, wherein a frangible package of goods may be introduced into the interior of the container through said open proximal end to be impaled on the previously inserted device, thereby permitting the contents of the frangible package to be released from the frangible package into the interior of the container, the device characterized by:

an apical piercing means oriented and stabilized in supported relation on a support means, the support means having a generally conical form defined by an apex, a base and a continuous outer concave surface intermediate said apex and said base, such that the support means is adapted to be positionable within the container with the apical piercing means extending within the container away from said distal end and towards said opening, and such that said support means is operable to spread the pierced frangible package and thereby enlarge the opening therein through which the contents of the package are released into the container, and such that said continuous outer surface of the support means is adapted to smoothly distribute an initial flow of contents outwardly towards the side wall of the container.

6. A container having a hollow interior defined between a distal end and a contiguous side wall extending upwardly from the distal end to a proximal end which is open to said interior, and supported apical piercing means oriented and stabilized in supported relation on support means positioned within said container with the apical piercing means extending within the interior, away from said distal end and towards said opening, whereby a frangible package of goods that is introduced into the interior of said container through said open proximal end is impaled on said piercing means, permitting the contents thereof to be released from the package into the interior of the container, characterized by said support means having a generally conical form defined by an apex, a base and a continuous outer concave surface intermediate the apex and base of said support means, such that said support means is operable to spread the pierced frangible package and thereby enlarge the opening therein through which the contents thereof are released into the container, and such that said continuous outer surface of the support means is adapted to smoothly distribute an initial flow of contents outwardly towards the side wall of the container.

7. A device having apical piercing means adapted to pierce a frangible package and being supported on support means at a first end thereof which is positionable in removable relation within a container having a hollow interior defined between a distal end thereof and a contiguous side wall extending upwardly from the distal end to a proximal end which opens into the interior, with said apical piercing means oriented and stabilized in operable position; and having a second graspable end spaced apart from the first end and adapted to extend exteriorly of said container when said first end is so positioned; and the apical piercing means is positionable in spaced apart relation from the side wall thereof, and the support means is adapted to extend from the first end towards the side wall, and then upwardly, adjacent the side wall towards the proximal end, and through the opening to the second end located exteriorly of the container, characterized by said support means further comprising a generally conical portion adjacent said first end, said portion defined by an apex, a base and a continuous outer concave surface intermediate the apex and base of said support means, such that said support means is operable to spread the pierced frangible packaging and thereby enlarge the opening therein through which the contents thereof are released into the container, and such that said continuous outer surface of the support means is adapted to smoothly distribute an initial flow of contents outwardly towards the side wall of the container.

* * * * *